United States Patent [19]

French et al.

[11] Patent Number: 4,746,794

[45] Date of Patent: May 24, 1988

[54] MASS ANALYZER SYSTEM WITH REDUCED DRIFT

[75] Inventors: John B. French, Thornhill; Donald J. Douglas, Toronto; John E. Fulford, Holland Landing, all of Canada; Peter Arrowsmith, San Jose, Calif.

[73] Assignee: MDS Health Group Limited, Etobicoke, Canada

[21] Appl. No.: 920,539

[22] Filed: Oct. 20, 1986

[30] Foreign Application Priority Data

Oct. 24, 1985 [CA] Canada ..... 493,741

[51] Int. Cl.[4] ..... H01J 49/26

[52] U.S. Cl. ..... 250/288; 250/281

[58] Field of Search ..... 250/281, 282, 288, 396 R

[56] References Cited

U.S. PATENT DOCUMENTS 4,135,094 1/1979 Hull ..... 250/423 R
4,146,787 3/1979 Fite ..... 250/305
4,148,196 4/1979 French et al. ..... 62/100
4,328,420 5/1982 French ..... 250/282

*Primary Examiner*—Carolyn E. Fields
*Assistant Examiner*—John A. Miller
*Attorney, Agent, or Firm*—Rogers, Bereskin & Parr

[57] ABSTRACT

A mass analyzer in which an ion signal, typically from a plasma, travels through an orifice into a vacuum chamber, and through a focussing system in the vacuum chamber into a mass spectrometer and ion detector. Drift of the detected ion signal, and differences in drift of the detected ion signal for different elements, are greatly reduced by a small shadow stop placed in the vacuum chamber immediately behind the orifice. The shadow stop and plate containing the orifice are both preferably grounded. The focussing system includes a Bessel box lens, and drift is further reduced by insulating the stop in the Bessel box lens from the barrel and biasing the Bessel stop differently from the barrel.

13 Claims, 6 Drawing Sheets

MASS ANALYZER SYSTEM WITH REDUCED DRIFT

FIELD OF THE INVENTION

This invention relates to apparatus for directing an ion signal into a mass analyzer located in a vacuum chamber, with reduced drift of the detected ion signal over a period of time.

BACKGROUND OF THE INVENTION

Mass analyzers for detecting and analyzing trace substances require that ions of the substance to be analyzed be introduced into a vacuum chamber containing the mass analyzer. It is often desired to perform elemental analysis, i.e. to detect and measure the relative quantities of individual elements in the trace substance of interest. U.S. Pat. No. 4,501,965 assigned to MDS Health Group Limited, the assignee of the present invention, describes a method and apparatus for conducting elemental analysis, in which the trace substance of interest is introduced into a high temperature plasma to reduce it to its individual elements. The plasma produces predominantly singly charged ions of the elements, which are directed through a small orifice into the vacuum chamber and which are then focussed into the mass analyzer.

Although instruments such as that described in the above mentioned U.S. patent operate well under laboratory conditions, they have been found to drift under some conditions of every day use. In other words, the detected ion signal may vary substantially over a period of time even when the concentration of the element being detected in the input sample remains constant. Even worse, the drifting is found to be markedly different from one element to another. For example, with constant input concentrations of elements A and B, the ion signals detected might decrease considerably over a period of time for element A and increase for element B. The drifting was found in some cases to be so large, rapid and non-uniform that recalibration of the machine at very frequent intervals was required, which was a severe nuisance.

BRIEF SUMMARY OF INVENTION

Therefore it is an object of the invention to provide means for sampling an ion signal into a vacuum chamber for mass analysis, in which the problem of drift in use is substantially reduced or at least, in which the responses to different elements A and B drift in the same direction by approximately the same amount. Accordingly in one of its aspects the invention provides apparatus for sampling an ion signal into a vacuum chamber, comprising:

(a) means for generating an ion signal, (b) a vacuum chamber including an orifice plate defining a wall of said vacuum chamber, (c) said orifice plate having an orifice therein adjacent said means for generating an ion signal, for sampling said ion signal through said orifice into said vacuum chamber.

(d) mass analyzer means in said chamber for analyzing said ion signal, (e) ion focussing means between said orifice and said mass analyzing means for focussing ions from said orifice into said mass analyzing means, (f) and a shadow stop in said vacuum chamber and located substantially immediately adjacent said orifice and on a line between said orifice and said ion focussing means, for reducing debris accumulating on said focussing means.

BRIEF DESCRIPTION OF THE DRAWINGS

Further objects and advantages of the invention will appear from the following description, taken together with the accompanying drawings in which.

DETAILED DESCRIPTION OF PREFERRED EMBODIMENTS

Figure 1:
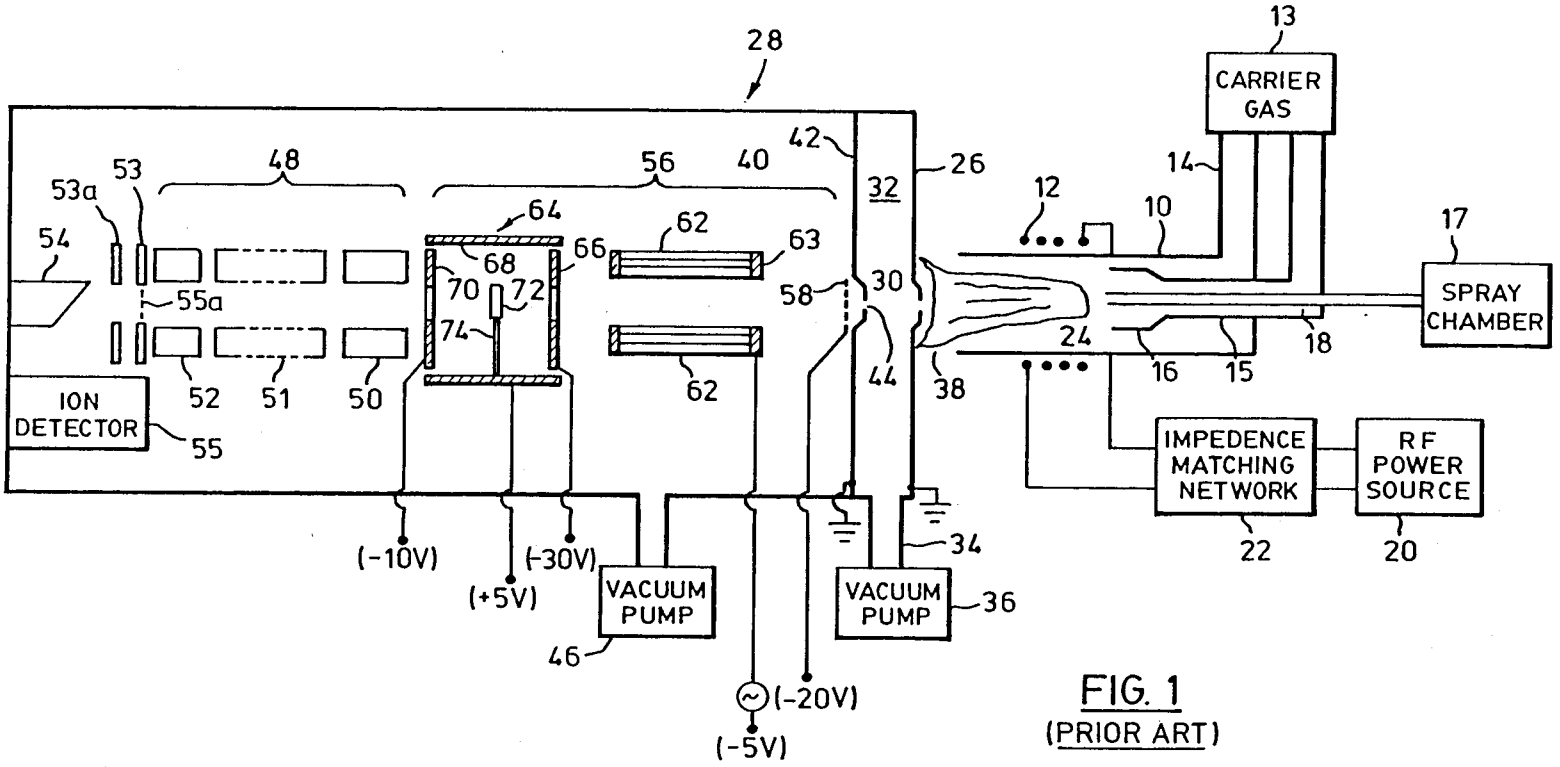
FIG. 1 (PRIOR ART)
FIG. 1 is a diagrammatic sectional view of a prior art mass analysis system.

Reference is first made to FIG. 1, which shows a known arrangement having a plasma tube 10 around which is wrapped an electrical induction coil 12. A carrier gas (e.g. argon) used to form the plasma is supplied from a source 13 and is directed via conduit 14 into the plasma tube 10. A further stream of the carrier gas is directed from the source 13 through an inner tube 15 within the plasma tube 10 and exits via a flared end 16 just upstream of the coil 12. An inert gas, e.g. argon, containing an acrosol of the trace substance to be analyzed is supplied from a spray chamber 17 and is fed into the plasma tube 10 through a thin tube 18 within and coaxial with the tube 15. Thus the sample is released into the center of the plasma to be formed.

The coil 12 is supplied with electrical power from an RF power source 20 fed through an impedance matching network 22. The power varies depending on the nature of the plasma required and may range between 200 and 10,000 watts. The energy supplied is at high frequency, typically 27 MHz. The plasma generated by this arrangement is indicated at 24 and is at atmospheric pressure. The coil 12 may be provided with means as indicated in the above mentioned U.S. patent to reduce undesired voltage swings in the plasma.

The plasma tube 10 is located adjacent a first orifice plate 26 which defines one end wall of a vacuum chamber 28. Plate 26 may be water cooled, by means not shown. Gases from the plasma 24 are sampled through an orifice 30 in the plate 26 into a first vacuum chamber section 32 which is evacuated through duct 34 by a pump 36. The remaining gases from the plasma exit through the space 38 between the plasma tube 10 and the plate 26.

The first vacuum chamber section 32 is separated from a second vacuum chamber section 40 by a second orifice plate 42 containing a second orifice 44. The second vacuum chamber section 40 is evacuated by a vacuum pump 46. Located in the second vacuum chamber section 40 is a mass analyzer indicated at 48. The mass analyzer may be a quadrupole mass spectrometer having entry rods 50 (which have an AC radio frequency potential between them and a common DC bias), main rods 51 (which have both AC and DC potentials between them), and exit rods 52 (which again have an AC potential and a common DC bias). Ions transmitted through the mass spectrometer 48 pass through exit lenses 53 and 53*a* to a deflector lens 54, which deflects them into an ion detector 55. Detector 55 produces an ion count signal for further processing. Lens 53 has a mesh 55*a* across its opening to provide an electrostatic shield, to prevent the field from lens 51*a* from entering the rods.

The ion signal entering the vacuum chamber section 40 through orifice 44 must be focussed into the mass spectrometer 48. Therefore ion focussing means generally indicated at 56 are provided. The ion focussing means 56 include a large circular wire open mesh disc 58 suspended (by means not shown) a short distance downstream of the orifice plate 42 and axially aligned with orifice 44. Downstream of mesh disc 58 are a set of AC only guide rods 62 (as described in U.S. Pat. No. 4,328,420 issued May 4, 1982) supported by discs 63 and having an appropriate AC potential between them and a common DC bias voltage, and a Bessel box lens 64, both also axially aligned with orifice 44. The Bessel box lens has a front lens 66, a barrel lens 68 and a rear lens 70. A central circular stop 72 is suspended in the middle of the barrel 68 by a rod 74 to prevent photons and other noise from entering the mass spectrometer. The stop 72 is electrically connected to the barrel 68 and is at the same potential as the barrel.

In use, the wire mesh disc 58 is typically biased at −20 volts DC, the guide rods 62 at −5 volts DC, the front lens 66 at −30 volts DC, the rear lens 70 at −10 volts DC, and the barrel 68 and stop 72 at +5 volts DC. These illustrative values are shown in parentheses in FIG. 1. The mesh disc 58 serves to prevent electrons and some negative ions from entering the vacuum chamber section 40 and initiating an unwanted electrical discharge. The remaining elements described focus the ion signal into the rods 50.

As indicated, it was found that the arrangement shown in FIG. 1 tended in some cases to drift severely during use. It was further found that the drift varied greatly from one analyte element to another. After considerable effort it was found that the cause appeared to be that materials from the plasma or other ion source tended to be deposited on the front rods 62 and on the Bessel box stop 72. For example, if rock was being analyzed, the deposited debris tended to be inorganic salts such as calcium oxide, magnesium oxide and aluminum oxide. If blood was being analyzed, the debris deposited tended to be sodium chloride and iron oxide. The coatings were resistive, causing the stop 72, the various lens elements, and the front rods 62 to charge. The charging changed the voltage on these parts. It was discovered that the detected ion signal was extremely sensitive to changes in the voltage on these parts, particularly on the stop 72. For example a voltage difference of 0.1 volts on the Bessel box stop 72 was found to produce a 10% change in the amplitude of the ion signal transmitted, at least for some elements and depending on the applied voltage.

Figure 2A:
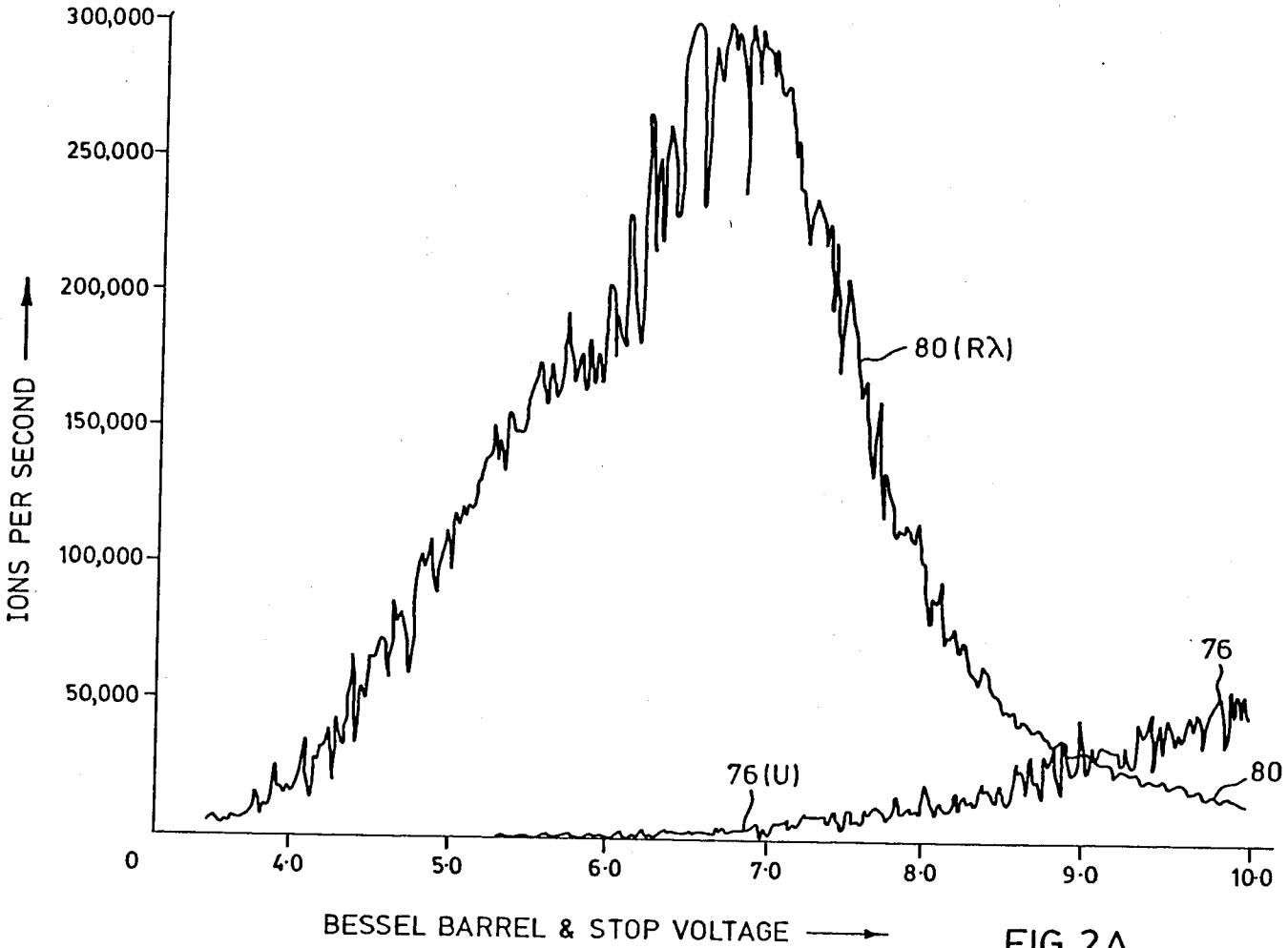
FIGS. 2A and 2B are plots of detected ion signal plotted against voltage applied to a stop and barrel in the FIG. 1 arrangement.
Figure 2B:
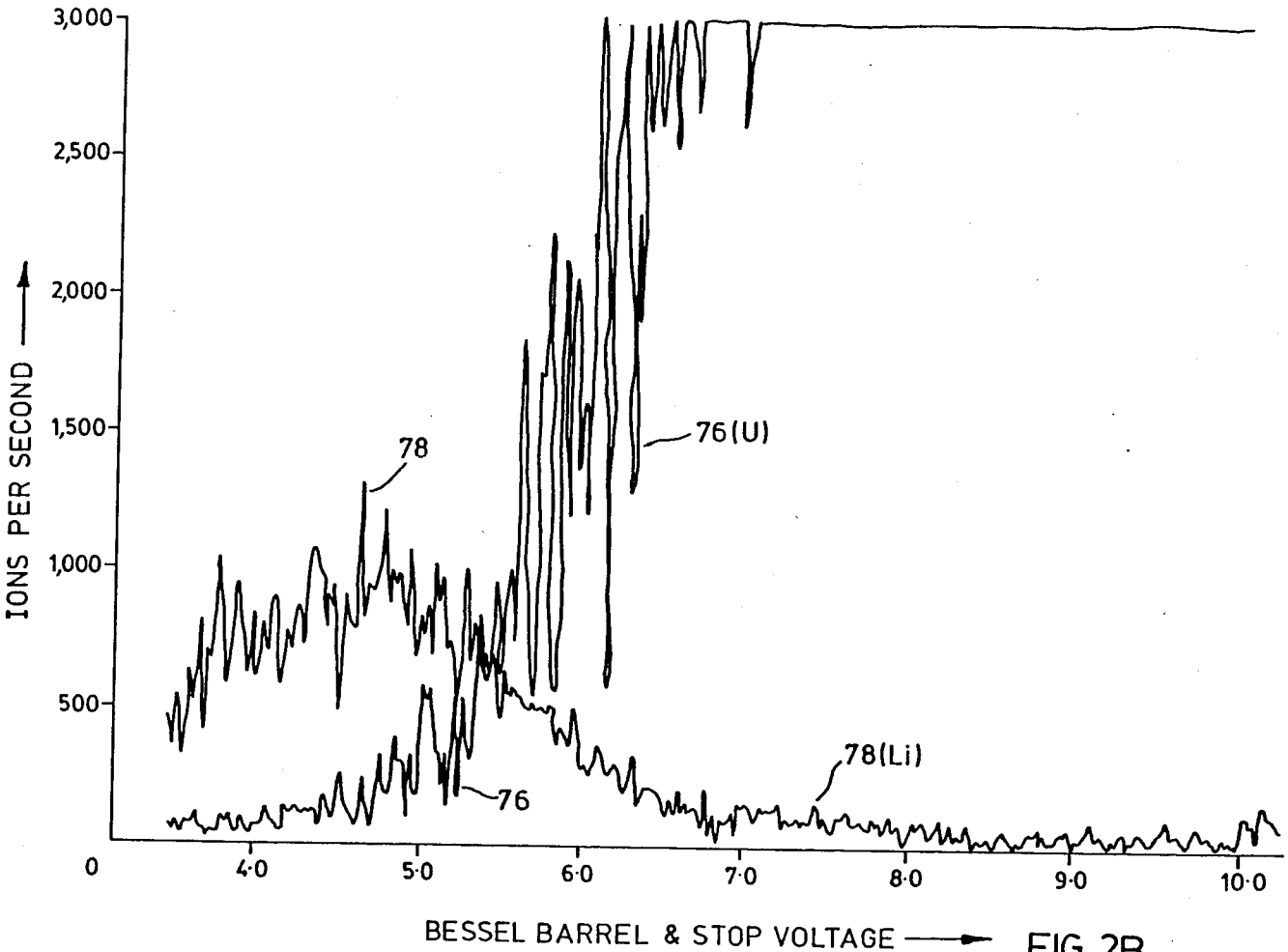

The problem is illustrated in FIGS. 2A and 2B, which show detected ion signal (counts per second) on the vertical axis and the voltage on the Bessel box barrel 68 and stop 72 on the horizontal axis. A sample solution containing 1.0 ppm (parts per million) of a test element was sprayed into the spray chamber 17 to produce an aerosol of the sample solution. The aerosol was fed into the plasma 24 through tube 18 to produce the signals shown. Curves 76, 78 and 80 are for the signals produced when the test element was uranium, lithium and rhodium respectively. (Uranium, curve 76, appears in both FIG. 2A and FIG. 2B, but the vertical scale in FIG. 2B has been expanded over that in FIG. 2A by a factor of 100.) It will be seen that the ion signal produced by the mass spectrometer varies enormously as the voltage on the Bessel box stop varies. In addition, the change is not uniform. For example when the voltage changes from 4 to 7 volts, the detected signal for uranium increases by a factor of about 30, the detected signal for lithium decreases by a factor of about 3, and the detected signal for rhodium increases by a factor of about 15. Since the change in response for each element differs as the voltage varies on the Bessel box stop 72, non-uniform drifting of the machine response occurs as the Bessel box stop charges during use.

It was also found that the ion signal response was highly dependent on the DC bias on the front rods 62. The ion signal response also varied fairly substantially with small changes on the bias voltage on the mesh disc 58 and also with variations in voltage on the front lens 66 and the rear lens 70. It was found that the most critical items in terms of sensitivity of ion signal to DC voltage change on the items were, in order of sensitivity, the Bessel box stop and barrel 72, 68, the front rods 62, the mesh disc 58, the front lens 66, and the rear lens 70. Changes in voltage on lenses downstream from the rear lens 70 appeared to produce much more minor changes in ion signal detected. In addition, downstream from the rear lens 70 there was little depositing of debris. This was because the Bessel box stop 72 shadowed the hole in the rear lens 70, and because the debris tended to travel in straight lines from the orifices 30, 44. It was found that the debris deposited near the center line appeared to have travelled straight through from the first orifice 30, while the debris deposited at larger angles indicated that the second orifice 44 was acting almost as a point source of debris.

Figure 3:
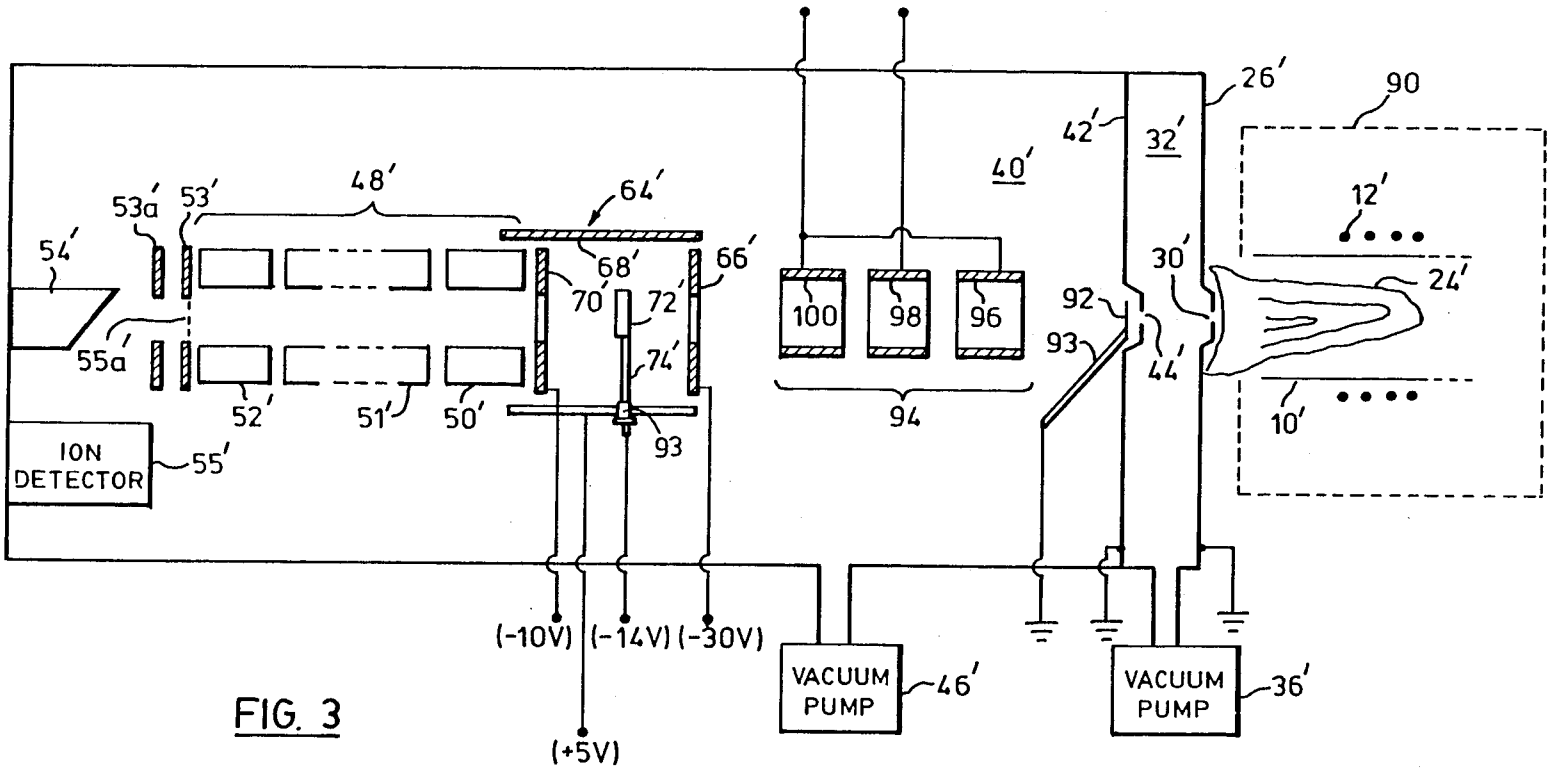
FIG. 3 is a view similar to that of FIG. 1 but showing a system according to the invention.

Reference is next made to FIG. 3, which shows a system according to the invention. In FIG. 3 the plasma and sampling system are the same as those of FIG. 1 and are therefore indicated simply by box 90. In FIG. 3 primed reference numerals indicate parts corresponding to those of FIG. 1. The FIG. 3 system differs from that of FIG. 1 as follows.

Firstly, the biased wire mesh disc 58 has been replaced by a shadow stop 92. The shadow stop 92 is a small solid electrically conductive metal disc suspended by a rearwardly inclined rod 93 in axial alignment with the orifices 30', 44' and located behind orifice 44'. The shadow stop 92 is small and is positioned very close to the orifice 44', i.e. immediately adjacent the orifice 44'. Typically the diameter of the shadow stop 92 ranges between 3.8 and 8.0 millimeters and in a preferred embodiment was 5.1 millimeters. The axial distance between the orifice 44' and the shadow stop 92 is typically 35 millimeters but can range between 20 and 60 millimeters. The diameter of the shadow stop 92 and its axial distance from the orifice 44' are selected so that the stop 92 shadows all of the aperture of front lens 66', thereby disallowing passage of the debris past the front lens plate 66'. (The orifice 44' itself is typically 0.85 mm in diameter and orifice 30' is typically 1.1 mm in diameter.)

The second difference is that whereas the wire mesh disc 58 was biased typically at −20 volts, the shadow stop 92 is preferably grounded. The two orifice plates 26, 42 are also preferably grounded. This was found to produce good results and also removes the need for a separate power supply to stop 92.

The third difference from the FIG. 1 arrangement is that the Bessel stop 72' is insulated from the Bessel box barrel 68' (by insulator 93) and is separately biased. Previously the front and rear Bessel box lenses 66, 70 were typically biased at about −30 and −10 volts respectively (although this could vary), and the barrel 68 was biased at about +5 volts. The bias on the front and rear lenses 66, 70 may remain unchanged in the FIG. 3 embodiment; the DC bias on the barrel 68 may remain unchanged at +5 volts, but the DC bias on the Bessel box stop 72' has been changed to −14 volts.

The fourth difference from the FIG. 1 apparatus is that the AC entry rods 62 have been eliminated and replaced by a triple cylinder or Einzel lens 94. This is a well known lens having three cylindrical lens elements, namely a front element 96, a central element 98 and a rear element 100. The front and rear elements 96, 100 are electrically connected together and in a preferred embodiment are biased at −15 volts. The central element 98 is typically biased at −130 volts DC.

Figure 4:
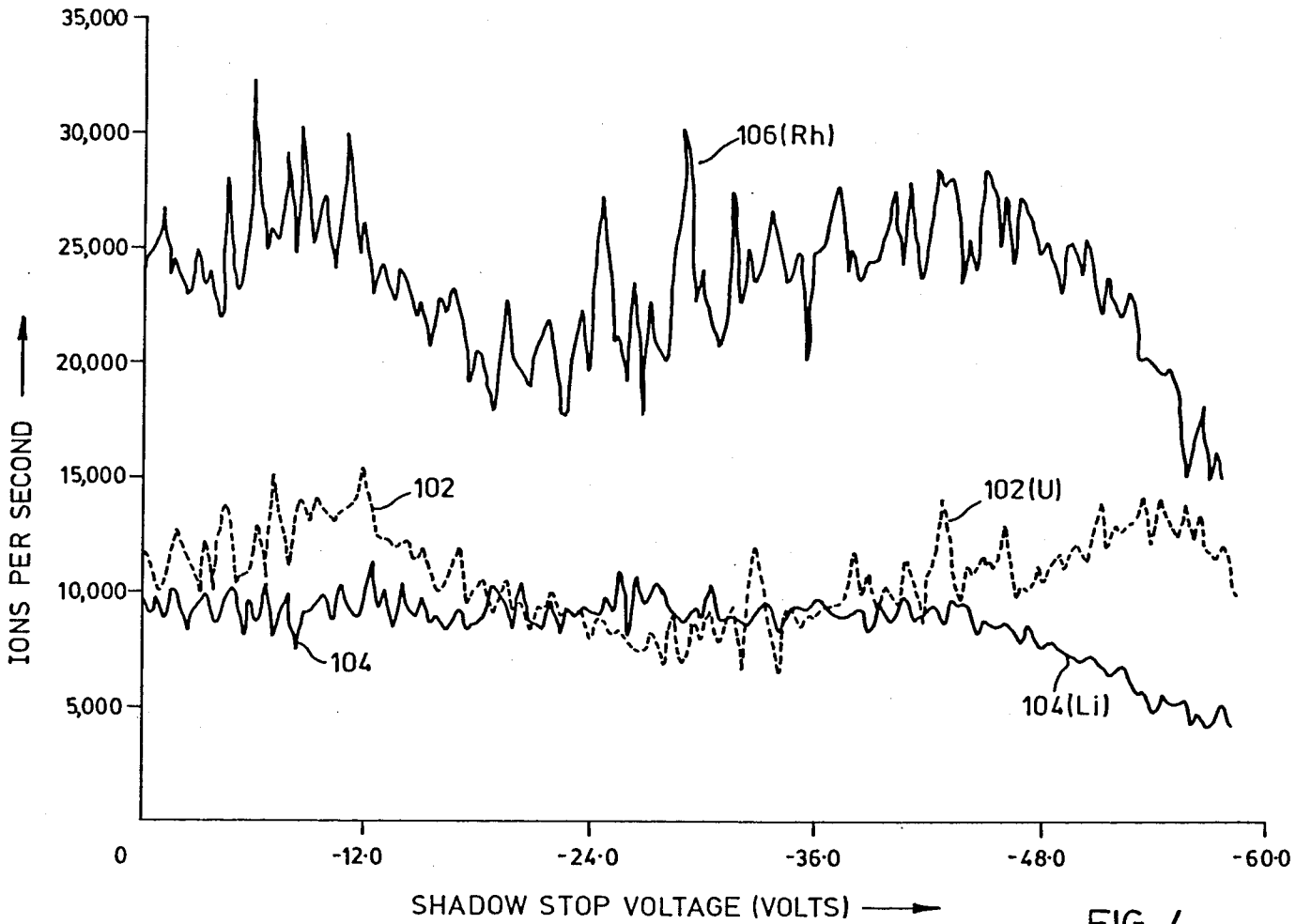
FIG. 4 is a chart showing detected ion signal plotted against voltage applied to a shadow stop of the FIG. 3 arrangement.

Reference is next made to FIG. 4 which shows detected ion signal on the vertical axis and the DC bias voltage on the shadow stop 92 on the horizontal axis for three elements. The elements are uranium (curve 102), lithium (curve 104), and rhodium (curve 106). It will be seen that for each curve, the response is relatively flat as the shadow stop voltage changes over a relatively large range. In addition at least over the first portion of the range (e.g. from 0 to −24 volts), the changes are all essentially similar. The result is that as debris accumulates on the shadow stop 92, tending to cause charging on such stop, the response of the apparatus drifts only to a very minor extent and the drift is relatively uniform for elements of varied mass.

It was found in one experiment that the drift in detected ion signal for the element uranium was only 1% in six to seven hours of use, employing a relatively dirty plasma. This compared with a previous drift of 100% over a space of seven hours, and of course the previous drift was highly non-uniform (i.e. it differed widely for different elements). In the FIG. 3 system, since the drift is now relatively uniform, it is possible to use an internal standard, such as niobium, which can be added to all solutions to be tested. If the niobium signal response drifts by 1%, then it is generally found that the other responses have drifted to the same extent.

Figure 5:
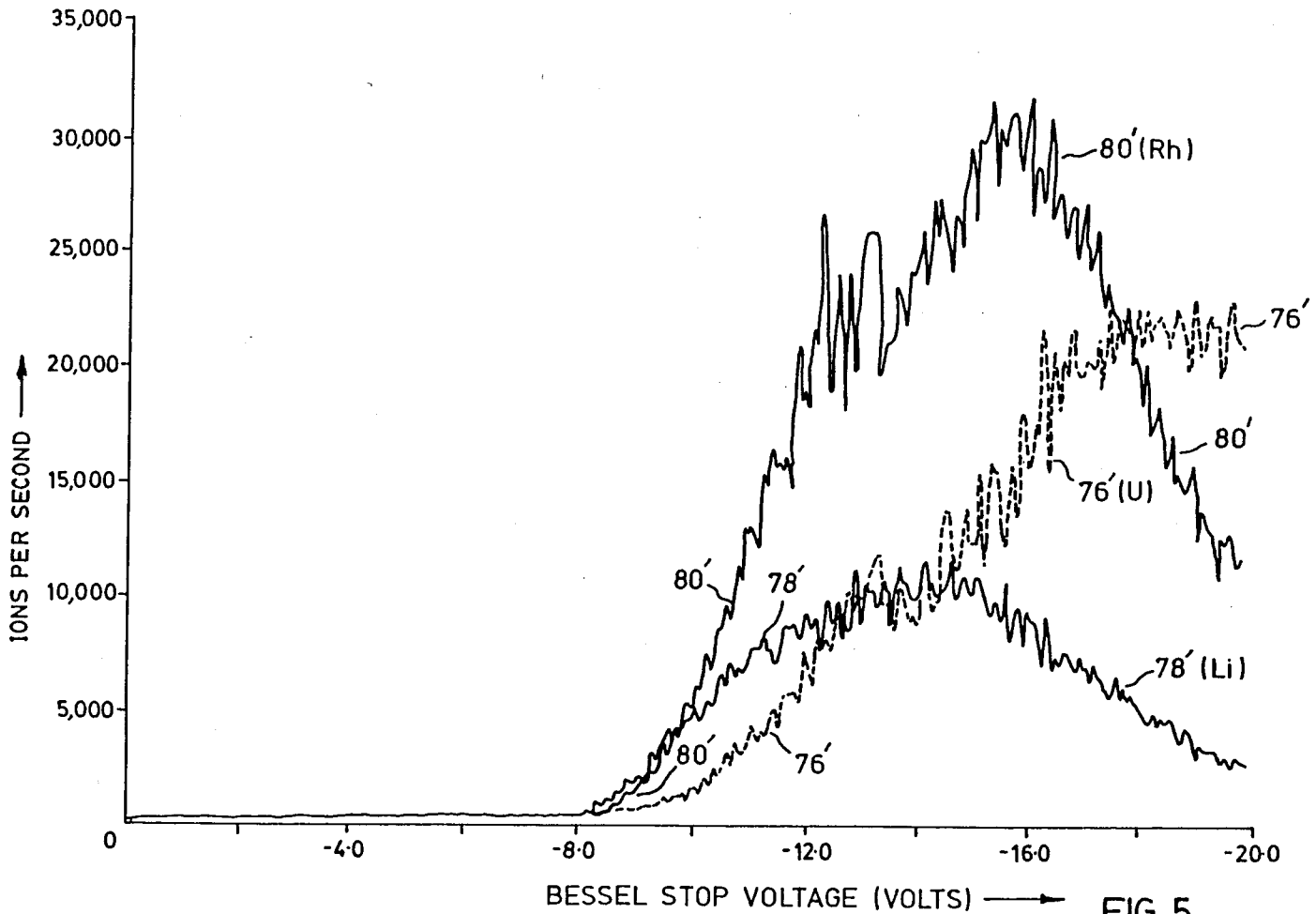
FIG. 5 is a plot showing detected ion signal plotted against voltage applied to a Bessel stop in the FIG. 3 arrangement.

Reference is next made to FIG. 5, which shows the change in detected ion signal with change of bias voltage on the Bessel box stop 72. In FIG. 5 primed reference numerals correspond to those in FIG. 2. Thus, in FIG. 5 the curves 76', 78' and 80' are for uranium, lithium and rhodium respectively. It will be seen that while the detected ion signal still varies markedly with the bias voltage on the Bessel box stop, the change over the range of interest, i.e. the typical operating range (from −12 to −17 volts) is less than in the FIG. 2 chart. In addition, since very little debris now accumulates on the Bessel box stop 72', the actual drift in voltage which occurs on that stop is far less than previously.

It was found that the shadow stop 92 interferes to some extent with ions entering the vacuum chamber through orifice 44'. The ion signal is reduced by a factor between 2 and 10 by the stop 92. However the stop 92 has an offsetting advantage in that it effectively creates an annular ion source. This blocks ions which would otherwise travel straight through the quadrupole system and which would be difficult to resolve. (Of course stop 72', so long as it is present, performs a similar blocking function.) In addition use of a separately biased Bessel box stop 72 increases the ion signal by a factor of between 2 and 40, and use of the Einzel lens 94 in place of the AC rods 62 enhanced the ion signal by a factor of between 2 and 3. The result was a net gain in the ion signal.

It was also found that the shadow stop 92 tended to some extent to be self cleaning when the ion source was a plasma 24'. Specifically, it appears that the edges of the shadow stop 92 were to some extent cleaned by the heat generated on the stop 92 and due to the plasma. However any debris removed from stop 92 in this self cleaning process did not appear to be deposited on the Einzel lens 94 or on the Bessel box elements.

It was found that the arrangement shown in FIG. 3 had a number of advantages over that of FIG. 1. The advantages included the following.

(1) As discussed, the ion signal to the mass spectrometer was increased.

(2) Drift of the detected ion signal over a period of time with dirty ion signal sources was substantially reduced. The instrument was much less sensitive to dirt accumulations. This appeared to be largely because the major dirt accumulations are now on a part (the shadow stop 92) whose variations in voltage do not seem to affect the detected ion signal as much as voltage variations in other parts.

(3) The detected ion signal was nearly optimized for all elements tested at approximately the same voltages on the shadow stop 92. The detected ion signal was also nearly optimized for all elements tested at approximately the same voltage on the Bessel stop 72' (which voltage of course was not the same as that on the shadow stop 92). In the prior FIG. 1 arrangement, the voltage on the Bessel stop 72 and barrel 68 that optimized the detected ion signal e.g. for uranium was very different from the voltage which optimized the detected ion signal for lithium.

(4) Because of advantage 3, the masses of the elements tested drifted largely in unison, rather than diversely (because voltage changes in the shadow stop 92 did not affect the responses of the various elements differently to the previous significant extent). This is an advantage since signals can now be normalized to one element to correct for drift (such one element then acts as an internal standard).

(5) Related to point 3 above, the flatness of the spectral response of the instrument was improved (e.g. the variation in sensitivity to uranium at the heavy end, lithium at the light end and elements in between was reduced).

(6) The isotope rate accuracy was somewhat improved, since the response was now more uniform for different isotopes. Previously the response tended to be different even for isotopes which were only a few atomic mass units apart.

(7) The annular ion source created by the shadow stop 92 blocked ions which would otherwise travel straight along the axis of the quadrupole system (if stop 72' were not present) and which would be difficult to resolve.

(8) The background noise level has become more uniform across the mass range and more independent of plasma operating conditions, partly because the AC only rods have been eliminated, and partly because there is an extra stop 92 to block photons, argon metastable atoms, and other species which may cause noise.

If desired, since the shadow stop 92 is in place the Bessel box stop 72' can be removed. The detected ion signal is then increased, but in addition the noise increases by a factor of about 100 because of ultraviolet photons entering the mass spectrometer. However it if found that it is possible to reduce such noise by bending the ion stream through an additional right angle turn after it leaves the back end of the mass spectrometer rods and before it enters the ion detector. The photons cannot follow such bending. Alternatively, the noise may be reduced by removing Bessel box stop 72' and using smaller apertures in lens elements 66' and 70'.

It will be appreciated that while the ion source disclosed is a plasma, other ion sources may also be used. However the invention is particularly useful with a plasma ion source, since such sources can generate a large amount of debris.

We claim:

1. Apparatus for sampling an ion signal into a vacuum chamber, comprising:

(a) means for generating an ion signal, (b) a vacuum chamber including an orifice plate defining a wall of said vacuum chamber, (c) said orifice plate having an orifice therein adjacent said means for generating an ion signal, for sampling said ion signal through said orifice into said vacuum chamber, (d) mass analyzer means in said chamber for analyzing said ion signal, (e) ion focussing means between said orifice and said mass analyzing means for focussing ions from said orifice into said mass analyzing means, (f) and a shadow stop in said vacuum chamber and located substantially immediately adjacent said orifice and on a line between said orifice and said ion focussing means, for reducing debris accumulating on said focussing means.

2. Apparatus according to claim 1 and including means electrically coupling said orifice plate and said shadow stop together for holding said orifice plate and said shadow stop at the same electrical potential.

3. Apparatus according to claim 2 wherein said potential is ground.

4. Apparatus according to claim 1 wherein said ion focussing means includes a Bessel box lens having a front lens element, a rear lens element and a cylindrical barrel between said front and rear lens elements, and a stop element in said barrel between said front and rear lens elements, and extending across the axis of said barrel, said front and rear lens elements, said barrel and said stop element all being insulated from each other, and means for applying a first electrical potential to said barrel and a second electrical potential to said stop element.

5. Apparatus according to claim 4 wherein said second potential is a negative potential.

6. Apparatus according to claim 4 and including means for electrically connecting said orifice plate and said shadow stop to ground.

7. Apparatus according to claim 1 wherein said shadow stop has a diameter of between 3.8 and 8.0 millimeters.

8. Apparatus according to claim 1 wherein said shadow stop has a diameter of approximately 5.1 millimeters and is located at an axial distance of about 35 millimeters from said orifice.

9. Apparatus according to claim 1 wherein said means for generating an ion signal includes means for generating a plasma.

10. Apparatus according to claim 1 wherein said ion focussing means includes an Einzel lens, and a Bessel box lens between said mass analyzer means and said Einzel lens, said Bessel box lens including a second stop therein, said shadow stop being of a size to shadow said second stop from debris entering said vacuum chamber through said orifice.

11. Apparatus according to claim 10 wherein said Bessel box lens includes a barrel, means insulating said barrel from said second stop, and means for biasing said second stop at one voltage and said barrel at a different voltage.

12. Apparatus according to claim 11 wherein said one voltage is a negative voltage.

13. Apparatus according to claim 12 wherein said Bessel box lens includes a front entrance plate having an aperture therein, and wherein said shadow stop is a metal disc formed from a conductive metal and is substantially of a diameter such as to shadow said aperture in said front entrance plate from debris entering said vacuum chamber through said orifice.

* * * * *